US009359778B1

(12) United States Patent
Kreizinger

(10) Patent No.: US 9,359,778 B1
(45) Date of Patent: Jun. 7, 2016

(54) THIXOTROPIC CONCRETE FORMING SYSTEM

(71) Applicant: Kenneth Robert Kreizinger, Fort Lauderdale, FL (US)

(72) Inventor: Kenneth Robert Kreizinger, Fort Lauderdale, FL (US)

( * ) Notice: Subject to any disclaimer, the term of this patent is extended or adjusted under 35 U.S.C. 154(b) by 0 days.

(21) Appl. No.: 14/606,193

(22) Filed: Jan. 27, 2015

Related U.S. Application Data

(63) Continuation-in-part of application No. 13/374,839, filed on Jan. 17, 2012, now Pat. No. 8,959,862.

(51) Int. Cl.
*E04G 11/20* (2006.01)
*E04G 11/00* (2006.01)
*B28B 1/093* (2006.01)

(52) U.S. Cl.
CPC ..... *E04G 11/00* (2013.01); *B28B 1/093* (2013.01)

(58) Field of Classification Search
CPC ..... E04B 2/8647; E04B 2/8635; E04G 11/12; E04G 11/20; E04G 11/22; E04G 11/30; E04G 17/14; E04G 9/05; E04G 17/0658
USPC ..... 52/464, 742.13, 742.14, 425, 426
See application file for complete search history.

(56) References Cited

U.S. PATENT DOCUMENTS 1,647,685 A 8/1925 Coopers
2,096,159 A 10/1937 Brynoldt
2,253,730 A 8/1941 Seailles
2,791,819 A * 5/1957 Carlsen ..... E04G 9/10 249/104
2,939,198 A * 6/1960 Nicholls ..... E04G 11/12 249/115
3,197,964 A 8/1965 Fehlmann et al.
4,787,597 A 11/1988 Yokota et al.
5,554,392 A * 9/1996 Gray ..... E04G 11/22 249/10
8,621,817 B1 * 1/2014 Kreizinger ..... E04C 3/00 264/71
8,950,156 B2 * 2/2015 Vandehey ..... E04F 13/00 52/415

OTHER PUBLICATIONS

U.S. Appl. No. 13/373,816, filed Dec. 1, 2011, Kreizinger.

* cited by examiner

*Primary Examiner* — Rodney Mintz
*Assistant Examiner* — Daniel Kenny

(57) ABSTRACT

The present invention discloses a method and a forming system that reduces the hydrostatic pressure caused by casting freshly mixed concrete or other cementicious material into a vertical form. Reducing the hydrostatic pressure in forms enables relatively weak materials to be used as forms and minimizes the amount of bracing necessary to support the forms—both of which lead to lower construction costs. The method uses the highly thixotropic properties of no-slump or low-slump concrete which enable the concrete to be quickly changed from a semi-solid state to a liquid state and back to a semi-solid state numerous times before it hardens and without affecting the concrete's quality. Since hydrostatic pressure is only present when a liquid state exists, minimizing the amount of liquid concrete in vertical forms will also minimize the hydrostatic pressure present.

13 Claims, 5 Drawing Sheets

THIXOTROPIC CONCRETE FORMING SYSTEM

CROSS REFERENCE TO RELATED APPLICATIONS

This application is a continuation-in-part of application Ser. No. 13/374,839 filed Jan. 17, 2012 which claims the benefit of the filing date of U.S. Provisional Application Nos. 61/461,437 filed Jan. 18, 2011 and 61/462,463 filed Feb. 3, 2011, all of which above cited applications are incorporated herein by reference.

BACKGROUND OF THE INVENTION

| Prior Art | | | |
|---|---|---|---|
| The following is a tabulation of some prior art that presently appears relevant: | | | |
| U.S. Pat. | | | |
| Pat. No. | Kind Code | Issue Date | Patentee |
| 5,554,392 | | Sep. 10, 1996 | Gray |
| 4,787,597 | | Nov. 29, 1988 | Yokota et al |
| 3,197,964 | | Aug. 3, 1965 | Fehlmann et al |
| 2,791,819 | | May 14, 1957 | Carlsen |
| 2,253,730 | | Aug. 26, 1941 | Seailles |
| 2,096,159 | | Oct. 19, 1937 | Brynoldt |
| 1,647,685 | | Aug. 25, 1925 | Coopers |
| U.S. patent applications | | | |
| application No. | | Filing Date | Applicant |
| 13/373,816 | | Dec. 1, 2011 | Kreizinger |

This invention discloses a method of using the thixotropic properties of no-slump concrete to significantly reduce the hydrostatic pressure that freshly mixed concrete exerts on a vertical form. Thixotropy is a material property that describes the ability of a highly thixotropic material, such as no-slump concrete, to change from a semi-solid state or gel-like state when at rest to a liquid state when vibrated. While in its semi-solid state, freshly mixed no-slump concrete exerts little or no hydrostatic pressure on the forms into which it is cast. Reducing the hydrostatic pressure in forms by minimizing the amount of concrete in a liquid state enables relatively weak materials to be used as forms and reduces the amount of bracing.

Cast-in-place concrete construction using forms to contain the freshly mixed concrete is the most widely used method of building vertical concrete structures such as walls and columns. Cast-in-place means that a concrete structure is cast in its final installed place and will not be moved as opposed to precast or tilt-up concrete that is cast in one place and installed in a second place. The process is based upon casting freshly mixed concrete into forms that are erected to several feet in height and are referred to herein as a "vertical form". In order to get the concrete to flow to the bottom of the vertical form and fill the entire form side to side, a higher slump and more liquid concrete is typically used. Once cast inside the form the concrete is vibrated for consolidation (the removal of entrapped air) and to ensure the concrete fills the entire form from side to side. Vibration is not needed when the concrete mix is a self-consolidating concrete that uses additives to produce a highly liquid concrete that acts similar to water in removing the air and filling the form.

It is well known in the art that concrete requires a relatively small amount of water to enable the hydration process to fully cure the concrete to its highest strength. However, this small amount of water produces a very dry, semi-solid state-like concrete that is unworkable in most applications and even more so when filling a tall and narrow form. To improve the concrete's workability, additional water and/or chemical additives are added that alters the concrete into more of a liquid state which easily flows into a vertical form. The degree of a concrete mixes' liquidity is typically revealed by the slump test with a very low or no-slump indicating a concrete mix in a semi-solid state and a very high slump indicating a highly liquid mix. As such, freshly mixed concrete can have the characteristics of a solid or a liquid.

One characteristic of a liquid is the existence of hydrostatic pressure which creates a major obstacle in concrete formwork since a liquid concrete weights about 150 lbs. per cubic foot which results in high lateral pressures on a vertical form. For example when a more liquid concrete is cast into a ten foot tall by ten foot long vertical form, the hydrostatic pressure along the bottom can be as high as 1,500 lbs. per square foot and the entire 100 square foot form can have as much as 53,000 lbs. of hydrostatic pressure that must be safely restrained. In order to handle such high amounts of pressure the concrete forms must be very strong, durable and well braced which makes them expensive. This is the reason concrete formwork accounts for as much as 60% of the cost of a plain cast-in-place concrete wall that many times has unsightly exposed form tie holes or patches.

In addition to the hydrostatic pressure caused by the liquefied concrete in the form, in some instances there may also be a vibratory pressure caused by the active vibration of the concrete that must be considered. While the hydrostatic pressure may be present throughout the entire form, the vibratory pressure is localized to the immediate area where the concrete is being vibrated. When combined the hydrostatic and vibratory pressures may magnify the lateral pressure exerted on the form and thereby require even stronger and more expensive forms.

The hydrostatic pressure has been restrained in concrete forms by using a combination of strong form materials, braces, studs, walers, form ties and clamps that support or hold the form sides together and are all well known in the art. Regardless of the forming system used, there is a direct relationship to the forming system's cost and the amount of hydrostatic pressure that must be safely restrained. The greater the hydrostatic pressure, the greater the cost of the forming system and a substantial reduction in the hydrostatic pressure will cause a substantial reduction in the cost of concrete formwork.

The existence of high hydrostatic pressure also limits the type of form material that may be safely or practically used and thereby prevents the use of finished cladding materials as stay-in-place forms. Finished claddings such as siding boards and brick and stone panels are not designed to withstand high lateral pressures, leaks or to be used with form ties and are therefore only attached to a hardened concrete wall. The result is redundant steps of setting and removing heavy concrete forms and then attaching the finished cladding as opposed to simply setting the finished cladding as stay-in-place forms. The additional steps of setting and removing formwork add considerable cost to the construction process.

The utilization of stay-in-place forms is well understood such as insulated concrete forms that provide both formwork and the building's insulation. However, since these insulated concrete forms are used with a more liquid, higher slump concrete, they are specially fabricated and require numerous form ties in very close proximity which increase their material and labor costs and thereby make them only slightly more cost effective than using removable forms.

The high levels of hydrostatic pressure also make it difficult, and thereby expensive, to build walls with architectural cast-in-place concrete. The form ties, which are typically used in cast-in-place construction to hold down costs, inhibit the use of form liners due to the fact that form ties obstruct the form faces and the cavity area between two sides of forms. Form ties are internal bracing that hold two sides of a form together by either connecting to or penetrating through the form faces and prevents unobstructed form faces which are best when using form liners or a stay-in-place material. The alternative of not using form ties require that the forms be extremely strong and able to transfer the pressure loads to the form's perimeter which results in even more costly and economically unfeasible forms.

Another problem with a more liquid concrete is that it requires that the form seams be much tighter and in the same plain so as to prevent leakage or an unsightly ridge on the hardened concrete. In addition, a more liquid concrete mix more readily flows into all openings and thereby inhibits the ability to use slip form stone masonry to build inexpensive brick or stone walls. Slip form stone masonry is the stacking the bricks or stones on the inside of a form and casting concrete behind them to build a brick or stone veneer concrete wall. This is only practical if the concrete is prevented from leaking to the front and staining the brick or stone which is almost impossible when using a highly liquefied concrete.

Despite the limitations caused by and the cost of dealing with hydrostatic pressure, there is no prior art that reduces the hydrostatic pressure in cast-in-place concrete except the standard practice of using a slower casting rate. When the concrete is cast and vibrated at a slower rate it gives the concrete at the bottom of the form time to setup (solidify) and thereby withstand the above hydrostatic pressures. However, a 50% slower casting rate may reduce only 30% of the hydrostatic pressure in the forms while taking twice as long to cast the concrete. At best a slower casting rate process only reduces a relatively small amount of pressure in the forms and there are many other variables that affect the speed in which the concrete begins to set up that limit the effectiveness of this practice.

Another way of reducing the hydrostatic pressure in cast-in-place concrete forms is by using a lighter weighing concrete. There are certain lighter weighing aggregates that can reduce the concrete weight by about 20% although they cost more and are only found in certain areas of the country which make their use cost prohibitive in most of the country. Foam or air injected into the concrete can also lighten it but the resulting concrete is much weaker, costs more and is seldom used.

Pneumatically spraying concrete is the only existing placement method that virtually eliminates the existence of hydrostatic pressure in freshly cast concrete. However, this process is not that widespread in buildings due to the additional placement and finishing labor and the high levels of rebound waste that combine to make it cost about the same as a formed concrete wall although with a somewhat lower quality finish.

There is no prior art that discloses a method of reducing the concrete's hydrostatic pressure in forms through the utilization of the thixotropic properties of the freshly mixed concrete. The thixotropy of freshly mixed concrete changing from a solid state to a liquid state and back to a solid state was disclosed in U.S. Pat. No. 2,253,730, although the method disclosed was for the rapid demolding of cast concrete products. The present invention uses this same material property for a very different purpose—to substantially reduce the hydrostatic pressure created by casting freshly mixed concrete into a vertical form.

SUMMARY OF INVENTION

The present invention discloses a method of reducing the hydrostatic pressure in a vertical form that is created when a freshly mixed concrete or other cementicious material is cast into the form. Reducing the hydrostatic pressure in forms enables relatively weak materials to be used as forms and minimizes the amount of bracing necessary to support the forms—both of which lead to lower construction costs. The method disclosed uses the highly thixotropic properties of no-slump concrete which enable the concrete to be quickly changed from a semi-solid to a semi-liquid and back to a semi-solid numerous times before it hardens and without affecting the concrete's quality. Since hydrostatic pressure is only present when a liquid state exists, limiting the amount of a liquid or semi-liquid concrete in a vertical form will limit the amount of hydrostatic pressure present.

For purposes of this invention, no-slump concrete in a semi-solid state shall mean that the concrete is in a gel-like state and capable of being vibrated and integrated with adjacent concrete. Whereas a semi-solid state for a higher slumped, more liquid freshly mixed concrete shall mean that the concrete has hardened to the point that it is no longer possible to vibrate and integrate the concrete. Basically, when freshly mixed no-slump concrete is at rest, it is in a semi-solid state whereas when freshly mixed higher slump concrete is at rest, it remains a semi-liquid until it begins to harden.

The process works by using freshly mixed no-slump concrete which is in a semi-solid or gel-like state when at rest and as a semi-solid exerts little or no hydrostatic pressure. To apply this to reducing the hydrostatic pressure in a vertical form the freshly mixed no-slump concrete is cast into the forms and, since it is in a semi-solid state, it exerts little or no hydrostatic pressure against the forms. When the no-slump concrete is consolidated through vibration the concrete is liquefied into a thick, semi-liquid and exerts hydrostatic pressure against the forms—but only while being vibrated. Once the vibration ends the concrete immediately reverts to the semi-solid state and stops exerting hydrostatic pressure. Moreover, only the concrete being actively vibrated is liquefied and exerts the hydrostatic pressure while all of the other no-slump concrete in the form, either before or after being vibrated, remains in a semi-solid state and exerts little on no hydrostatic pressure. This also enables the ability to turn the hydrostatic pressure on or off inside the forms at any time during the casting process. All of this occurs regardless of the size of the form and regardless of how long it takes for the concrete to cure.

As an example, if an entire ten foot long by ten foot high vertical form is filled with a high slump, liquid concrete there is up to 53,000 lbs. of hydrostatic pressure in this 100 square foot form. Conversely, if that same form is filled with freshly mixed no-slump concrete that is in a semi-solid state, there is no hydrostatic pressure in the form until some of that concrete is vibrated and liquefied. Assuming the concrete contained in only one square foot of the form is vibrated and liquefied at any one time, then this is the only concrete exerting hydrostatic pressure in the form and totals about 150 lbs. of pressure. When the vibratory pressure is added, depending upon the vibrator's force, the total lateral pressure exerted on the forms is only about 300 lbs., which is less than 1% of the 53,000 lbs. of hydrostatic pressure created by the same sized form filled with a liquid concrete. In addition, the no-slump concrete can be cast and vibrated as fast as possible to fill the entire form without increasing the hydrostatic pressure present in the form to very much above the 300 lbs.

It should be noted that by its very nature hydrostatic pressure is much greater at the bottom of the forms and is of little of no concern at the top of the forms. Therefore it is much more important to limit or prevent the hydrostatic pressure from extending below some point near the top area of the form. This can be done by using no-slump concrete in the bottom of the form and limiting the amount of higher slumped concrete above it.

The use of the word forms includes both the form boards that contain the concrete and the bracing that support the form boards as well as all related hardware. When the concrete is cast inside a vertical form its hydrostatic pressure is exerted on or against the form boards which transfer the load to the braces that are supported by other braces or a fixed object such as the foundation or the ground. The form boards can only withstand a certain amount of lateral pressure exerted on their span between the braces and the braces can only withstand a certain amount of pressure transferred to them from the form boards. The more no-slump concrete being vibrated at any one time, the greater the lateral pressure on the form boards and the braces.

To limit the amount of the no-slump concrete that at any one time is being liquefied, consolidated, integrated and flowing, the amount of concrete that is being vibrated and/or the amount of vibratory pressure must be limited. The manner in which this is done can be accomplished through several ways. For example, the amount of concrete being vibrated may be limited by simply vibrating a smaller area of the concrete at any one time with smaller and/or fewer vibrators. Limiting the vibratory pressure can be done by using fewer vibrators and/or vibrators that have less force. In those instances where more than one vibrator is being used to liquefy the concrete at any one time, it is also important to control the location of the vibrators. A set of forms designed to withstand the lateral pressure caused by a single vibrator may not be strong enough to withstand the lateral pressure created by two or more vibrators actively vibrating the no-slump concrete when located near each other. Each brace and each form board between braces can only withstand so much pressure and if multiple vibrators are located such that they cause too much lateral pressure on a form board or a brace, the forms can fail. However, multiple vibrators may be actively and simultaneously used if their locations are such the lateral pressure they create is properly distributed over the forms so as not to overload any form board or brace.

Given the importance of limiting the concrete vibration to prevent too much lateral pressure on the forms, it is important to predetermine the amount of concrete that can be vibrated at any one time, in any one location, in order to prevent exerting more pressure on the forms than they are designed for.

For purposes of this invention, the term "no-slump" concrete shall include a "zero-slump" concrete with sufficiently high thixotropic properties that enable it to be liquefied when vibrated and also a "low-slump" concrete that acts more like a semi-solid than a liquid when at rest and generally has a slump of less than one or two inches. The term concrete includes all cementicious materials and can be mixed with or without additives and with a wide variety of materials. The only necessary common characteristics are the mix's ability to have "no-slump" and be highly thixotropic. The term "highly thixotropic" shall refer to the concrete's ability to be sufficiently liquefied to enable it to be thoroughly consolidated and able to flow to fill the form's immediate area, eliminate honeycombing and to fully encase the concrete reinforcement. Additives may be used to increase the thixotropic properties of the concrete.

In the preferred embodiment of this invention, the vertical form is a tall form-short form combination that comprises a set of concrete forms. The tall form-short form combination is accomplished by erecting forms, on at least one side of a concrete structure to be cast in place to at least the full predetermined height that is to be monolithically placed, i.e. the full height of the monolithic concrete structure to be cast in place inside the vertical form. This represents the "tall form" side. The steel reinforcement is then set in place in the area to be cast along with any other embedments and the box-outs for any window, door or other openings. A first level of forms on the second side are erected to a predetermined height equal to or higher than the first lift to be cast, which is generally about 12 to 48 inches high. This is the "short form" side. The tall form side and the short form side create a cavity between them and the forms can then be inspected with the first level of forms on the short form side providing an indication as to the wall's depth and the concrete coverage over the steel reinforcement.

It is important to note that a concrete structure being built may be taller than a single monolithic concrete structure or comprised of several monolithic concrete structures that are cast above one another. As such, forms may be erected on the tall form side to a height greater than the monolithic concrete structure being cast.

The tall form-short form combination are cast and consolidated from the "short" form side in lifts of limited height so as to visually ensure the no-slump concrete is adequately placed, i.e. the concrete has filled the form to some height and is thoroughly consolidated and integrated into adjacent concrete. After each level of forms on the short form side is erected, the forms are at least partially filled with concrete to a predetermined height and vibrated. The vibration liquefies the concrete and causes it to be consolidated, which is the removal of entrapped air that induces a closer arrangement of the solid particles in freshly mixed concrete. When vibrating the concrete it is important that the vibration extends into and liquefies the outer layer of any adjacent, previously vibrated concrete so as to integrate the consolidated concrete and produce a monolithic concrete structure. Each level of forms may be cast and vibrated in one or more lifts. After the level of forms is cast and vibrated the next level of forms are erected and the process repeated until the full height of the vertical form is cast.

The reason for the tall form-short form combination is to ensure the concrete is adequately placed, i.e. the concrete fills the form to some height and is thoroughly consolidated and integrated to produce a compacted, monolithic concrete structure with a quality appearance. When casting a vertical structure, the lower the concrete slump, the greater the likelihood of honeycombing or concrete voids. This problem is exasperated by large amounts of rebar or boxed out areas which further inhibit the concrete's fall into forms and can cause it to get hung up on the rebar or cause segregation. This is especially a problem when the forms are set with a cavity between them of less than 15" wide and even more so when the cavity is 12 or less inches wide. As a result, the use of no-slump concrete requires that the concrete be visually consolidated and integrated to ensure the concrete is filling the entire form from side to side and produces an acceptable finish.

Visual consolidation and integration simply means that at least the top of the concrete being vibrated can easily be visually observed to have sufficient liquefaction to thoroughly consolidate and integrate the concrete in the immediate area. When no-slump concrete is mixed with the same amount of water from job to job and the vibrator is operated in a trained and consistent manner, it becomes easy to recognize when the concrete has been thoroughly consolidated and integrated by observing the top of the concrete being vibrated. Given that most concrete forms are erected with a narrow 4" to 8" cavity in which to place the concrete and the cavity has numerous obstructions such as rebar and form ties, it is not possible to adequately see the top of concrete being vibrated unless there is sufficient light and the vibrator operator's vision is in close proximity and has minimal or no visual obstructions. Since the first lift of concrete placed has no prior lift to be integrated with the first lift's concrete is only visually consolidated.

This is accomplished by casting a progression of "short" forms which allow the concrete to be cast into the form much closer to where it is finally positioned as opposed to having to fall through several feet of obstacles. The short forms also enable the internal vibrators easier access into the cast concrete and provide a visual assurance that the concrete is thoroughly consolidated and integrated. As the first level of short forms are being filled with concrete, vibrated, consolidated and integrated in a horizontal progression, the second level of short forms are erected behind this progression, above the first level that has been cast and vibrated and the process repeated to the full height of the structure. Basically, the short forms are being set and placed with concrete one level or lift at a time. For purposes of this disclosure, a lift is defined as a single horizontal level of concrete placed in a vertical form out of several lifts needed to fill the vertical form to the full height of the monolithic concrete structure being cast inside the form. For example a 12" lift means a 12" high level of freshly mixed concrete is placed in a horizontal progression in the vertical form.

Only one short form side is necessary for the vertical form and all of the remaining sides may be erected to at least the height of the short form side prior to casting the concrete. In addition, much or all of the bracing may be erected on the short form side prior to casting so as to simplify and speed the erection of each of the levels of forms during the casting process. It is important to note that since there is much less hydrostatic pressure present, the form boards require little or no hardware and may simply rest against or be clipped to the bracing. Such a simplified erection process will also make it possible to position all or most of the braces prior to casting and position all or most of the short form side form boards during the casting process.

A tall form-short form configuration also enables the vertical form to be used for casting concrete against an existing vertical backing such as an embankment, wall or other vertical structure that becomes the one form side, typically the tall form side. In this case the short form side is erected and no-slump concrete is placed inside the vertical form one lift at a time. The vertical form may have more than two sides in this and other cases, such as for the end of wall or column forms.

The existence of a short form side also facilitates a type of slip form stone masonry to build inexpensive brick or stone veneer concrete walls. In this embodiment the form boards set on the short form side are used to support brick, stone, tiles, siding and metal, glass, plastic or composite panels or a variety of other cladding materials as concrete is cast in the form and behind the cladding material. The cladding materials will either naturally bond to the concrete or may be specially prepared to chemically bond or form a mechanical attachment. The thick no-slump liquefied concrete will not "leak" to the front of the cladding materials to cause unsightly stains. As each level of forms is erected, the cladding material is simply stacked inside, against the interior side of the form board which is the form face, and the concrete is cast and vibrated. The seams may be grouted after the form boards have been removed, which could within an hour of the concrete's placement.

The vertical form is comprised of form boards or other well known types of forms used in concrete construction to form vertical form's sides. However, slip forms that come into direct contact with the cast concrete and are slipped from position to position are specifically excluded from this disclosure due to their many limitations. The vertical form herein is either a full height form or may be stacked to the full height of the concrete structure being monolithically cast.

In another embodiment of this system, one or more or all of the sides of the vertical form may be erected to less than the full height of the concrete structure to be monolithically cast. After form boards or other types of forms are sufficiently erected a first lift of no slump concrete is placed between the forms, followed by erecting another level of forms which is again followed by another lift of no-slump concrete being placed and the process continues until all sides of the forms are erected and the vertical form has been placed with concrete to the full height of the monolithically cast concrete structure. Basically, concrete may be placed in a partially erected set of forms until or near the final lift when the forms have to be fully erected in order to contain the last lift of concrete.

The concrete may be internally or externally vibrated by methods well known to the art. The forms should be designed to withstand the amount of hydrostatic pressure created plus any additional pressure created by the vibrator used in each application. Since the amount of hydrostatic pressure is directly related to the amount of concrete being vibrated and liquefied at any given time, the vibration area can be decreased by shorter vibrating heads or smaller radius of action from internal vibrators. Minimizing external vibration may be accomplished with directional force vibrators applied to the outside of the forms which will limit the amount of concrete being vibrated.

The no-slump concrete may be cast into the forms by any means capable of moving a no-slump or low-slump concrete such as a conveyor, bucket, pump, auger, spraying or other means well known in the art. A chute or an elephant trunk may also be used to direct the concrete into the form and to prevent segregation.

A substantial reduction in the amount of hydrostatic pressure permits the use of a substantially weaker and less expensive forming system. A removable forming system may be made of inexpensive molded plastic form panels or use thin plywood or other lightweight materials. The form boards may also be able to have much longer spans between the braces. Such weaker forms are much lighter and easier or less expensive to handle, set and remove than the heavy, reinforced plywood or metal forms now used to withstand the high levels of hydrostatic pressure.

A natural feature of no-slump concrete is its tendency to setup and harden into its solid state much faster than a higher slump concrete, sometimes in as little as one hour after placement. Such a rapid setup time allows the forms to be removed within an hour or two after casting and thereby may be used two to five times in the same day. Moreover, the capability to quickly expose the newly cast concrete offers the potential to score or otherwise alter the face of the concrete while it is still in a semi-plastic state.

As such, despite the fact the bottom lift of concrete in a vertical form may have hardened before the top lift is placed, a monolithic structure is still possible since each lift of concrete has been integrated during placement into any adjacent lift below.

Since the forms may be much weaker than those used to withstand much higher hydrostatic pressures, this invention makes it possible to use conventional wall cladding materials as stay-in-place form boards. Such wall claddings or cladding materials include horizontal wood or plastic siding, various types of panels, and bricks or stones attached to panels. These claddings are typically not used as form boards because they are too weak to withstand the conventional concrete pressures. The cladding material may mechanically bond to the concrete or the concrete facing side may be coated with an adhesive that will chemically bond to the freshly mixed concrete.

Thin plastic forms may also be used as either stay-in-place or removable and/or reusable forms. As stay-in-place form boards, the plastic forms may be glued or mechanically attached to internal supports or braces, connected to the second form side or otherwise supported by external braces. In addition, the stay-in-place plastic form boards may have a bonding material on the inside to adhere to the concrete or it may have ridges that embed into the concrete. These plastic form boards may have brick, stone or other material bonded to their exterior side so as to create a finished appearance for the completed concrete structure. As removable and/or reusable forms these thin plastic form boards may be reinforced with external ribs for longer spans between bracing.

The reduced hydrostatic pressure also enables the use of off-the-shelf, rectangular foam boards or other insulation boards or panels for use as stay-in-place forms or form boards. These common insulation boards and panels require much less bracing and may be used without form ties or with far fewer form ties than found in most insulated concrete forming systems. Form ties are herein defined as internal bracing extending from form to opposite form, holding the forms together and penetrating or connecting to the form's inside face in some manner so as to secure the tie to the form. As such, the form ties obstruct the interior side of the form, i.e. the form's inside face.

Given that the amount of hydrostatic pressure in the forms is reduced from tens of thousands of pounds to a few hundred pounds, a much weaker bracing system or far less braces may be used to hold the form boards in place. For example, a vertical brace may only be secured at the bottom and the top and span several vertical feet with little or no intermediate support and be horizontally spaced ten or more feet apart. Form board braces may be stay-in-place internal, removable external or braces that travel with the vibration. Traveling with the vibration simply refers to braces that are moved along the forms as the exerted lateral pressure is moved.

The wall cladding form boards may be equipped with an internal bracing system, which is one that is to the inside of the form boards and will be embedded in the concrete or an external bracing system outside the form board and typically removable. When internal braces are used, the cladding or removable form boards must be attached to the brace so as to prevent the cladding or form board from being pushed away from the brace when the concrete is either cast or vibrated. The internal braces may be a type of form tie or other lateral support or connector that attaches the form board to the other side of the form or some internal structure such as steel rebar. When external braces are used, the cladding or form boards may be simply stacked and vertically supported by the external braces such that minimal or no attachment to the brace is necessary. When the concrete is cast, the form boards are sandwiched between the concrete and the external brace. After the concrete is cured, the brace is simply unsecured at its top and bottom and pulled away from the cladding or form boards.

Accordingly, one advantage of this invention is to reduce the cost of concrete formwork by using much weaker, simpler and less expensive forming systems to withstand a much smaller amount of hydrostatic pressure present in forms.

Another advantage of this invention is the ability to use wall cladding materials as stay-in-place concrete forms and eliminate the redundant steps of using removable forms.

Another advantage of this invention is the ability to use much less bracing to support the various types of stay-in-place or removable forms.

Another advantage of this invention is to eliminate the use of form ties in cast-in-place concrete construction so as to provide an unobstructed inside form face. This enables the fast and efficient use of form liners and creates a less costly method of building architectural cast-in-place concrete walls or other vertical structures. The lack of form ties also enables a type of slip form stone masonry to build brick or stone veneer concrete walls as a significant cost savings.

Another advantage of this invention is that there is far less likelihood of concrete leakage since the concrete is much thicker when liquefied. This enables the forms to be simply butted together or otherwise use minimal connection and also prevent leakage to blemish the face of stay-in-place cladding materials used as forms or placed inside of forms.

Another advantage is that it permits the removal of forms within an hour or two after casting and thereby enables the forms to be used multiple times a day and/or the exposed wall to be worked on before it has fully hardened.

Another advantage of this invention is that it efficiently utilizes a horizontally oriented forming system which is consistent with many finished wall claddings such as siding, brick and stone that are also horizontally oriented.

Another advantage of this invention is that it provides a process by which the concrete cast into a vertical form can be visually observed, in close proximity and with sufficient light, while it is being vibrated to ensure the concrete fills the form and is thoroughly consolidated and integrated.

Another advantage of this invention is that it enables the use of off-the-shelf foam boards as stay-in-place forms that require little or no form ties.

Other objects, advantages and features of my invention will be self evident to those skilled in the art as more thoroughly described below.

DETAILED DESCRIPTION ACCORDING TO THE PREFERRED EMBODIMENTS OF THE PRESENT INVENTION

The present invention discloses a method of utilizing the thixotropic properties of freshly mixed concrete to significantly reduce the concrete's hydrostatic pressure in a vertical form. Thixotropy is a material property that describes the material's ability to changes from a semi-solid or gel like state to a liquid state when agitated. Both no-slump and low-slump freshly mixed concrete have a very high degree of thixotropy and are in a semi-solid or gel-like state when at rest. However, when vibrated they become liquefied and remain so until the vibration ends, at which time they immediately revert to their semi-solid state. While in the semi-solid state, whether before or after vibration, the freshly mixed no-slump concrete exerts little or no hydrostatic pressure on the forms into which it is cast.

Figure 1:
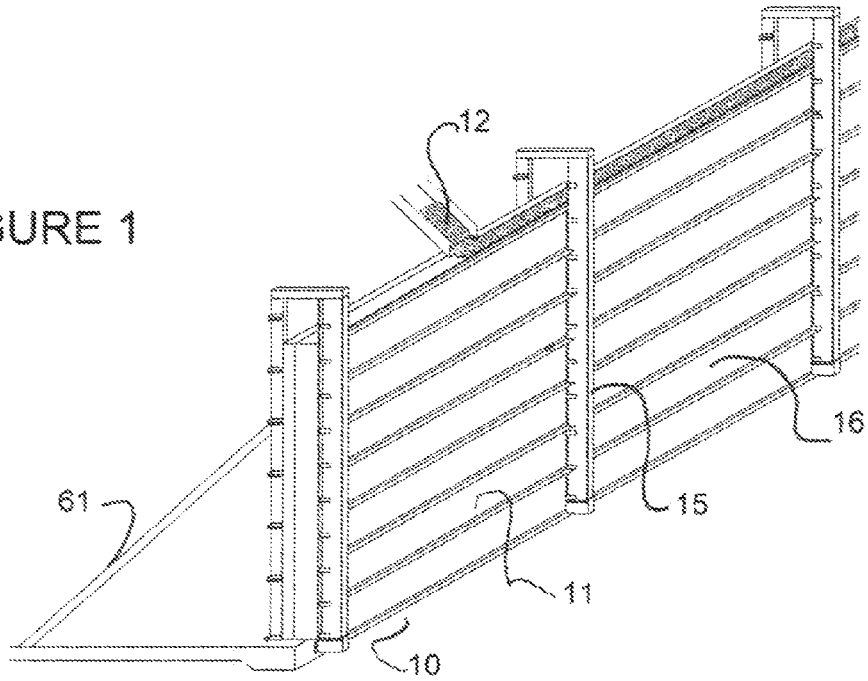
FIG. 1 is an isometric view of a fully erected vertical form into which concrete is being cast.

FIG. 1 shows a vertical form 10 built from a set of forms comprised of concrete form boards 11 on two sides that are facing each other and are supported by external vertical bracing 15 and horizontal bracing 16 and is being cast with freshly mixed no-slump concrete 12. The no-slump concrete 12 fills the form 10 to a predetermined height and while undisturbed remains at rest in a semi-solid state. The no-slump concrete 12 refers to the concrete while it is still plastic, has some degree of workability and before it has hardened into its permanent solid state. When the concrete hardens into its solid state, it exerts no hydrostatic pressure and depending upon its stiffness while in its semi-solid state, the no-slump concrete 12 exerts little or no hydrostatic pressure on the form 10.

The no-slump concrete 12 may fill the form 10 to whatever height that enables the concrete to be thoroughly vibrated. Since the no-slump concrete is in a semi-solid state, it does not flow as a liquid and has a tendency to get hung-up on steel reinforcement or other obstacles such as box-outs and embedments located inside the form 10. The inability to flow prevents the concrete from filling the entire form 10 side to side and results in large voids or honeycombed areas. To prevent this it may be necessary to cast and vibrate the concrete in several lifts of one to three feet in height and vibrate each lift before the next lift is cast. This will allow a visual observation into the form to ensure that the concrete is adequately placed by falling to the full depth and has been thoroughly vibrated, consolidated and integrated.

Figure 2:
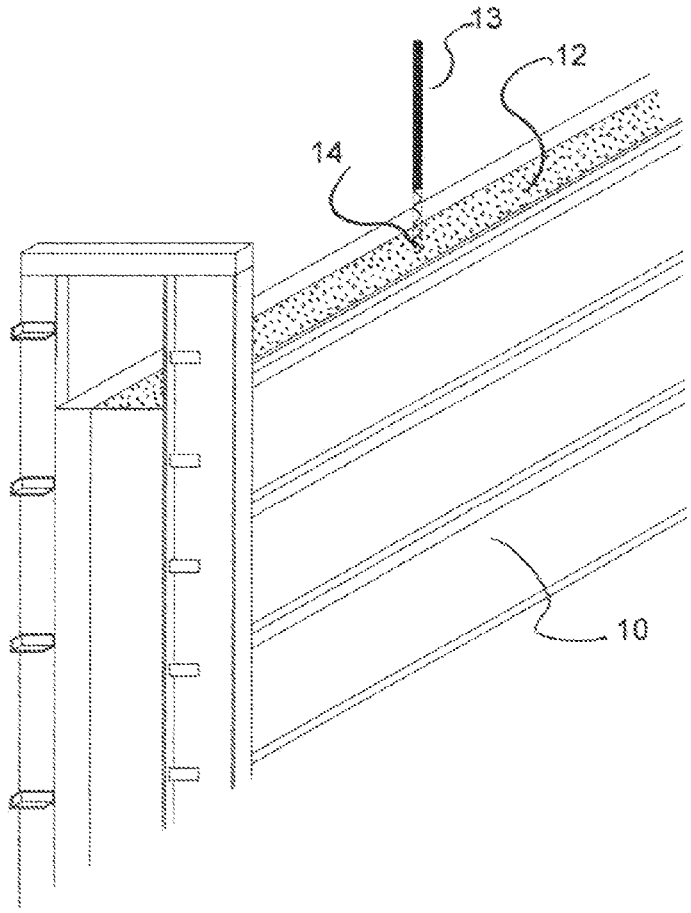
FIG. 2 is an isometric view of an enlarged section of FIG. 1 showing an internal vibratory being lowered into the concrete.

FIG. 2 is an enlarged drawing of FIG. 1 that shows an internal vibrator 13 with a vibrating head 14 being lowered into the no-slump concrete 12 to vibrate it. As the internal vibrator 13 is lowered into the concrete, it causes the no-slump concrete 12 in the immediate area of its vibrating head 14 to become liquefied. While being liquefied the no-slump concrete 12 consolidates and flows to fill the immediate area of the form 10 and exert a lateral pressure on the form 10 caused by both the liquefied concrete's hydrostatic pressure and any vibratory pressure. However, this lateral pressure is limited to the immediate area of the vibrating head 14 with all adjacent no-slump concrete 12 that is not being liquefied remaining at rest and in a semi-solid state. As such, both the no-slump concrete 12 that has been vibrated and the no-slump concrete 12 yet to be vibrated are at rest in their semi-solid state and exerting little or no hydrostatic pressure on the form 10.

Figure 3:
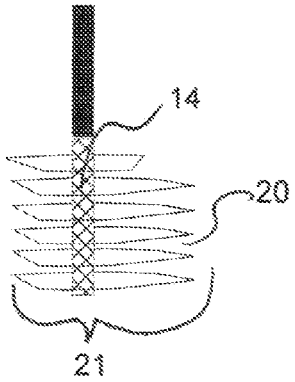
FIG. 3 is a section view of an internal vibrator in motion.
Figure 4:
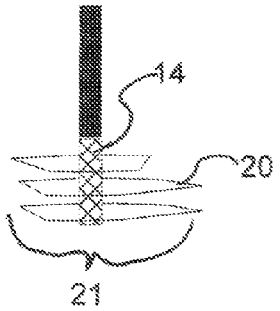
FIG. 4 is a section view of a smaller internal vibrator in motion.

FIG. 3 shows an enlargement of the vibrating head 14 and the radius of action 20 around the vibrating head 14 that determines the vibration area 21. FIG. 4 is the same drawing as FIG. 3, except the vibrating head 14 is much shorter and the resulting vibration area 21 is much smaller. A smaller vibration area 21 will actively vibrate and liquefy less concrete and thereby cause less hydrostatic and lateral pressure to be exerted on the form 10.

In all cases, when vibrating the concrete it is important that the vibration extends into and liquefies the outer layer of any adjacent, previously vibrated concrete so as to integrate the consolidated concrete and produce a monolithic structure. For purposes of this invention, a monolithic structure shall mean that each subsequent lift, after the first lift, of the freshly mixed no-slump concrete is integrated with the freshly mixed concrete placed in the immediately proceeding lift such that the concrete structure when cured consists of a solid, one piece and cold joint free structure. Integrate shall mean that the concrete from a present lift is mixed into and consolidated with previously placed, adjacent concrete. The adjacent concrete refers to the concrete on both the lateral side and any concrete that may be below the presently vibrated concrete. This concrete may be re-vibrated at any time prior to its hardening to the point that it cannot be vibrated, which for no-slump concrete is about one to three hours after casting.

Figure 5:
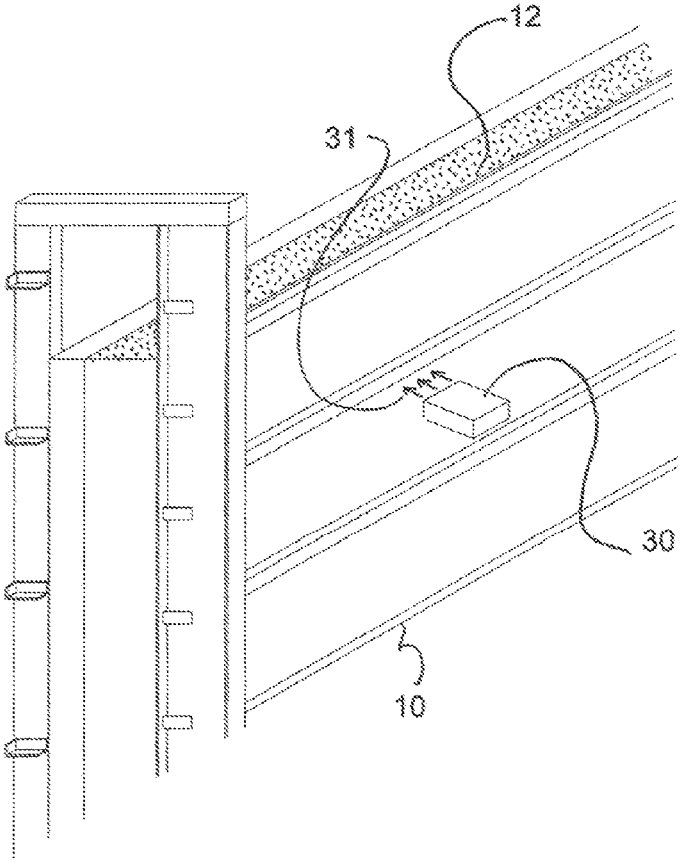
FIG. 5 is an isometric view of a vertical form filled with concrete with an external vibrator being applied to the form boards.

FIG. 5 shows an external vibrator 30 applied to the outside of the form 10. The external vibrator 30 is a directional vibrator that causes its vibrations to go in a certain direction 31. In this case the external vibrator 30 is directing its vibrations through the form 10 and into the concrete immediately in front of the external vibrator 30. Only the no-slump concrete 12 to the front of the external vibrator 30 is being actively vibrated and liquefied through the full depth of the form 10 at any given time and all other concrete in the form 10 is at rest and in its semi-solid state. The external vibrator may be moved, relocated and reengaged by any means along the surface of the form 10 including manually, on tracks and/or secured with clamps.

By using no-slump concrete 12 and liquefying only a limited amount of the no-slump concrete 12 at any given time, the lateral pressure exerted on the form 10 is limited to the hydrostatic pressure caused by the amount of concrete being actively liquefied and any vibratory pressure. All of the no-slump concrete 12 not presently being vibrated is at rest and in a semi-solid state such that it exerts little or no lateral pressure on the form 10. This includes any concrete above the area being vibrated that is not in a liquid state. By significantly reducing the freshly cast concrete's hydrostatic pressure in a vertical form, substantially weaker forms or form boards may be used and without form ties and less bracing may be used to cast the same amount of concrete.

However, it may be undesirable and unnecessary to cast the full height of a vertical structure with no-slump concrete. For example, it is easier to finish the top of a concrete structure when the concrete has a higher slump. In addition, in some cases straps or other items may be partially embedded into the top of a concrete structure which is easier to do when the concrete has a higher slump.

It is also unnecessary to cast the top lifts of a monolithic concrete structure with no-slump concrete in order to limit the hydrostatic pressure in the forms since the hydrostatic pressure at the top of the structure is already limited by its small height. For example a 12" wide by 12" high top lift of a highly liquid concrete mix will only exert about 150 psf of pressure on the forms since the hydrostatic pressure is limited to a 12" high lift. This small amount of hydrostatic pressure is not an issue since it is about the same pressure exerted on the forms when a cubic foot of no-slump concrete is vibrated and liquefied at any point in the forms.

As such, the placement of no-slump concrete in a vertical form shall refer to the lower lifts, a predetermined height or a predetermined area of the forms where increased hydrostatic pressure is an issue. However, the top lift or some area of the vertical form that will have low levels of hydrostatic pressure or where hydrostatic pressure is predetermined not to be an issue for any reason, may be cast with either no-slump concrete or some amount of a higher slumped concrete.

The no-slump concrete may be vibrated more than once after it has been placed and before it hardens which may be an hour or longer after casting. The ability for re-vibration enables the freshly placed concrete lift to be integrated into the previously cast lift to obtain a monolithic pour. The re-vibration does not adversely affect the concrete and the only hydrostatic pressure created is by the concrete being liquefied whether by the initial vibration or re-vibration.

A vertical form of this invention is a form used to build vertically oriented structures such as walls and columns. Such structures may be built in one or more monolithic castings. A vertical form is typically built with a set of forms and has two or more sides and, when fully erected, extends vertically the full height of each monolithic casting. The set of forms include any combination of form boards or other forms and optional form liners that hold the concrete or cladding material in place and all of the bracing components that support and hold the form boards in place. A level of forms refers to a partial height of a full set of forms and also includes the form boards, optional form liners and the respective bracing. A level of forms may be on one or multiple sides of the vertical form. Both a set of forms and a level of forms are erected by setting both the form boards and their respective bracing in place and prepared for casting.

The form boards of this invention are forms used to build vertical structures and thereby have vertical faces. They may be of any size and may have a rectangular or irregularly shaped form face that may be multi-directional. They may also have a much longer dimension in either the horizontal or in the vertical plane and as such are herein referred to as either horizontally or vertically oriented. The form boards may be removable or stay-in-place and made of any material including foam, wood, plastic, metal, paper, cardboard, glass, ceramic, brick, stone or a composite. As such, the form boards include insulation boards and finished claddings that may adhere or otherwise be attached to the concrete and stay-in-place after casting. The bracing includes walers, studs and lateral supports either outside the form boards or that are embedded in the concrete to support one or more form boards. The bracing may be made of any material including wood, metal, plastic or a composite.

In another embodiment of this invention, a method of using a tall form-short form combination is disclosed that ensures the no-slump concrete fills, is thoroughly consolidated and integrated throughout the entire form. This is important since no-slump concrete does not flow as a liquid concrete when placed and has a tendency to get hung-up in the forms to cause honeycombing or voids. This tall form-short form combination is also useful in using forms liners or in using finished wall claddings as stay-in-place forms.

Figure 6:
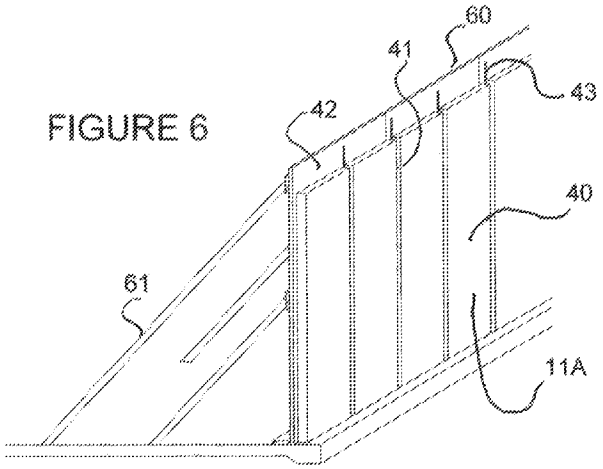
FIG. 6 is an isometric view of a full height of one side of a set of forms after erection.

One configuration of the tall form-short form combination is shown in FIGS. 6 to 12. FIG. 6 shows the tall form side 60 comprised of stay-in-place foam boards 40 that are used as the interior form boards 11*a* which are set in place vertically oriented and braced 61. The foam boards 40 may be rectangular shaped and have indentations to allow for deeper column area 41 and for a deeper beam 42. The concrete wall's reinforcement, rebar 43 and wire mesh (not shown) are placed to the inside of the form boards 11*a*. Any material may be used as the form boards 11*a* for the tall form side 60 and may be removable or stay-in-place forms with a variety of configurations, attachments and finishes, all well known in the art.

Figure 7:
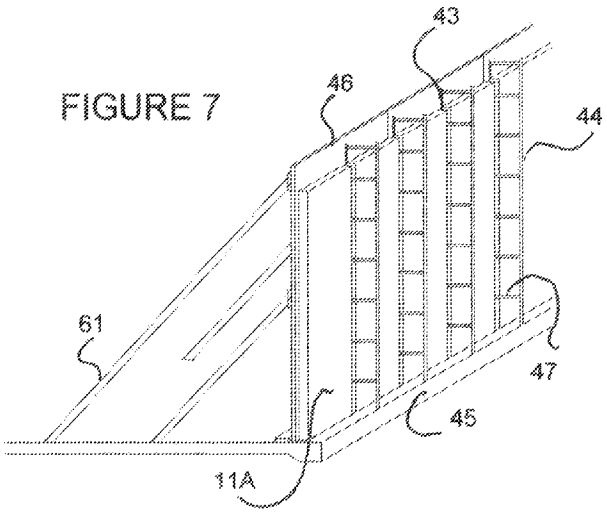
FIG. 7 is an isometric view of FIG. 6 with internal studs and lateral supports added.

In FIG. 7, internal studs 44 are positioned and secured at the bottom to the slab or foundation 45 and also at or near the top 46 of the concrete wall to be cast. The internal studs 44 may be secured with lateral supports 47 connected to the rebar 43, the form boards 11*a* or to braces or other solid object on the front side of the form boards 11*a*. The internal studs 44 may be made of any individual or composite material that can be embedded into concrete such as metal, plastic or wood. It is important that the internal studs 44 provide a straight, plumb and rigid frame since they support and provide the bracing for the exterior forms and cladding in this configuration. A stronger internal stud 44 will require fewer lateral supports 47 than a weaker internal stud 44.

Figure 8:
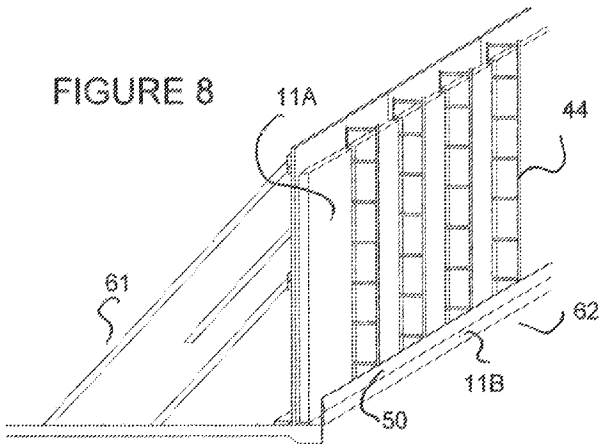
FIG. 8 is an isometric view of FIG. 7 with the first level of forms set on the short form side.

The short form side 62 is shown in FIG. 8, with two horizontally oriented form boards 11*b* positioned and secured to the internal stud 44 bracing and comprising the first level of forms on the short form side 62. In this configuration the form/cladding 50 are horizontally oriented siding boards that double as form boards 11 and as a cladding that will stay-in-place after the concrete cures to provide the exterior wall finish. The term "horizontally oriented" refers to the form face having a greater horizontal dimension than vertical dimension. The exterior form/cladding 50 is secured to the internal stud 44 bracing by nails, screws, tie wire or similar means.

Figure 9:
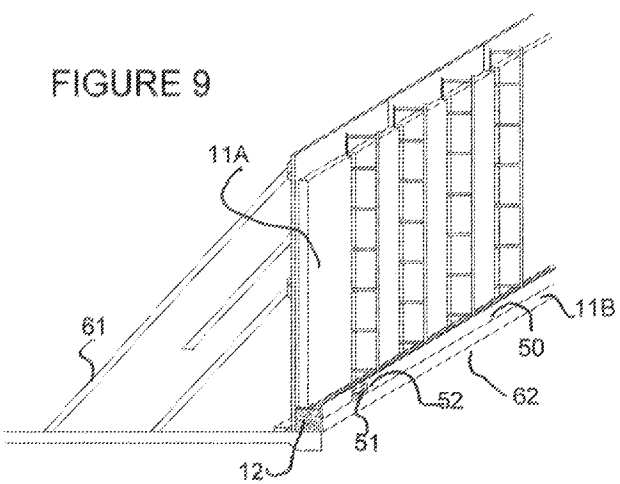
FIG. 9 is an isometric view of FIG. 8 with concrete cast into the forms.

FIG. 9 shows the first lift of no-slump concrete 12 cast into the form area, i.e. a cavity between the form boards 11*a* and 11*b* which are also referred to as the foam boards 40 and the exterior form/cladding 50. The no-slump concrete 12 is vibrated with either an internal vibrator as shown in FIG. 2 that is well known in the art, or externally by moving an external vibrator 51 manually, or mounted on a frame 52, across the face of the exterior form/cladding 50. The short forms enable a clear visual observation inside to ensure that the no-slump concrete 12 is adequately placed by being vibrated, thoroughly consolidated, integrated and flowing to fill the entire area being vibrated.

Figure 11:
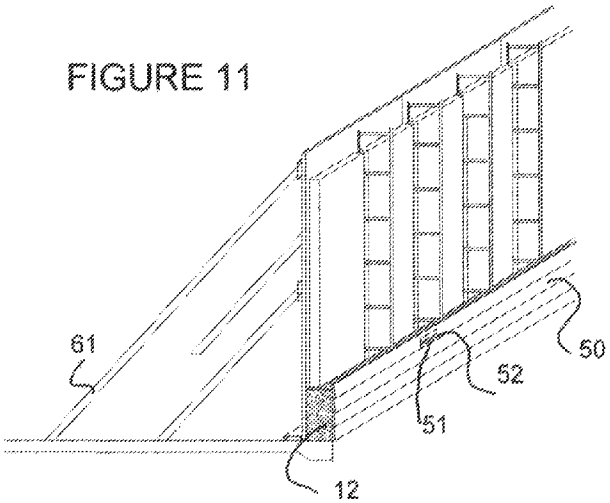
FIG. 11 is an isometric view of FIG. 10 with concrete cast into the forms.
Figure 10:
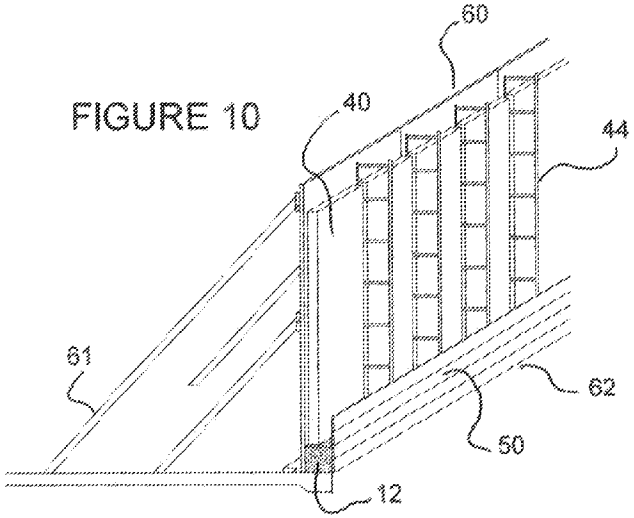
FIG. 10 is an isometric view of FIG. 9 with a second level of forms set on the short form side.

After the first level of short forms have been erected and the no-slump concrete placed inside the cavity between the two form sides, the next level of forms are erected by stacking two rows of exterior form/cladding 50 above the first rows and secured to the internal stud 44 bracing as shown in FIG. 10. The no-slump concrete 12 is then cast into this cavity as shown in FIG. 11 and vibrated either internally (not shown) or externally by moving the external vibrator 51 and frame 52 along the surface of the exterior form/cladding 50. When vibrating a new lift, it is important to simultaneously vibrate the joint area between the bottom of the new lift and the top portion of the prior lift so that the two concrete lifts are integrated to create a monolithic casting.

The process repeats itself by erecting successive levels of forms and placing the no-slump concrete in each level before the next level of forms is erected until the full height of the concrete wall is placed. By using no-slump concrete 12 the hydrostatic pressure is eliminated inside the set of forms that are comprised of the form boards 11*a* and 11*b*, except in the small area were the concrete is being actively vibrated. The small amount of hydrostatic pressure that is created by the vibration enables the use of much weaker forms and bracing and also permits the concrete wall to be cast to almost any height without increasing the lateral pressure on the set of forms.

Figure 12:
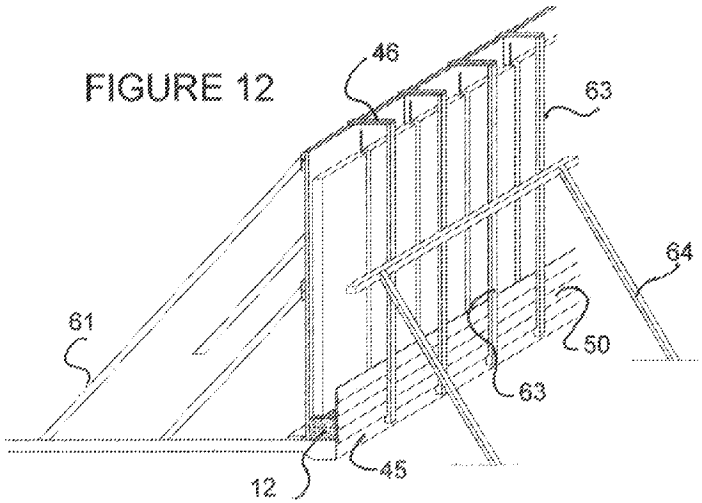
FIG. 12 is an isometric view of a full height of forms on the tall form side and two levels of forms on the short form side that are braces by a external studs.

FIG. 12 shows another embodiment of this invention where external studs 63 are used as bracing for the exterior form/cladding 50. In FIG. 12, the external studs 63 are mechanically attached to the foundation 45 at the bottom and have a top lateral connection 46 to the tall form side 60 and may be braced with a shore 64 as needed. The exterior form/cladding 50 is then slipped to the inside of the external studs 63 and may be mechanically secured to or simply rest against the external studs 63. The external studs 63 provide sufficient support to the exterior form/cladding 50 to withstand the lateral pressure created as the no-slump concrete 12 is cast and vibrated in the area immediately behind the exterior form/cladding 50.

Since the amount of hydrostatic and vibratory pressure in the forms has been significantly reduced, the exterior form studs 63 in FIG. 12 need minimal bracing and may, for example, only to be secured at the top and bottom and externally braced in the center. Stronger studs are able to span several feet from top to bottom which enables the total elimination of form ties in many cases. The absence of form ties facilitates an unobstructed inside form face and enables an economical use of form liners to create architectural cast-in-place concrete walls. This may be done with either vertically oriented or horizontally oriented form liners. Of special note is the fact that the horizontally oriented form liners used on the short form side 62 are consistent with the horizontal orientation of many wall claddings such as siding, brick and stone.

Vertical forms may be entirely internally braced, entirely externally braced or some combination thereof. For purposes of this disclosure, predominately exterior braced or predominately interior braced means the vertical form is all or mostly braced from either the exterior or the interior.

Figure 13:
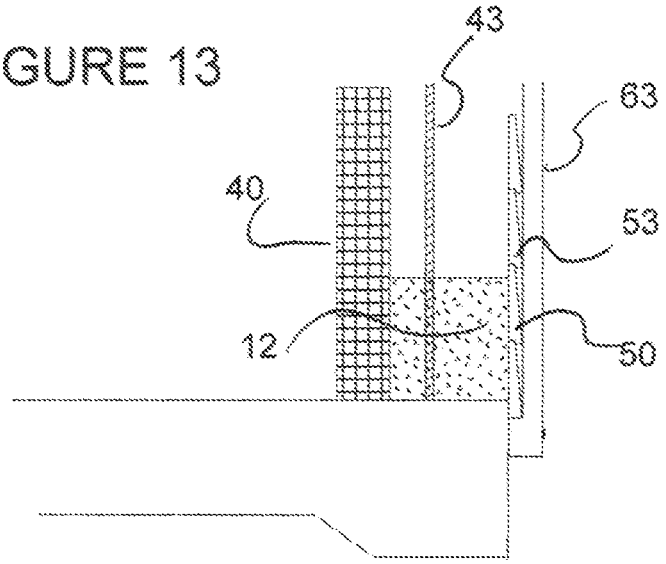
FIG. 13 is a side section view of an enlarged section of FIG. 12.

FIG. 13 shows a side view of FIG. 12 and the bracing provided by the external studs 63 that are supporting a siding board 53 as the exterior form/cladding 50. In this embodiment the siding is stacked as conventionally installed and its outside surface rests against the external studs 63. As the concrete is cast between the siding board 53 and the foam board 40, the weight of the concrete secures the siding firmly against the external studs 63. Once the concrete has sufficiently hardened, the external studs 63 are disconnected at the top and bottom and pulled away from the siding board 53. The siding board 53 may have a means of mechanically attaching or bonding to the wet concrete or it may have a bonding material placed on its back that chemically bonds to the concrete.

Figure 14:
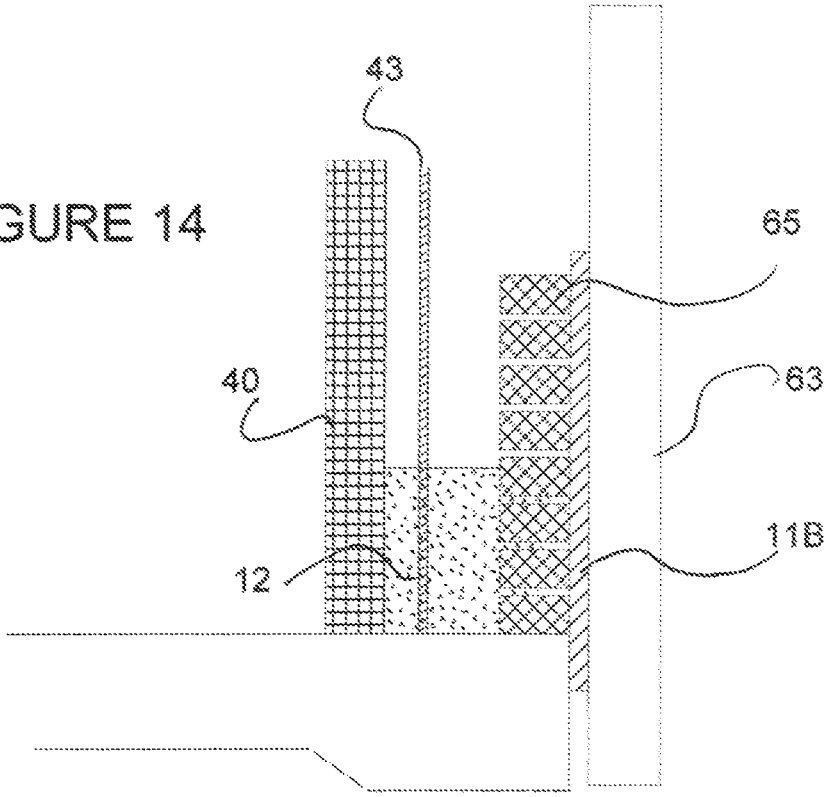
FIG. 14 is a side section view showing bricks being laid up inside the short form side of the set of forms of this invention.

In another configuration of this invention, FIG. 14 shows a concrete wall being cast with a brick veneer cladding by simply stacking the bricks 65 against the inside of a form board 11*b*. In this configuration a removable, horizontally oriented form board 11*b* is used instead of the exterior form/cladding and is supported by the external stud 63. After a few levels of brick 65 are laid up inside the form board 11*b*, no-slump concrete 12 is cast in the area between the brick and the foam board 40 and vibrated before the next level of form boards 11*b* and additional bricks 65 are set and the process is repeated until the full height of the wall is completed. In this configuration the foam boards 40 may be fully or only partially stacked to the fully height of the wall being cast prior to casting any concrete. In addition, almost any type of cladding material or system can be placed against the inside of the form board and attached to the cast concrete including foam boards and all types of wall claddings.

It should be noted there are several variations to the above configurations. For example in FIGS. 6 to 12, the foam boards 40 and the form/cladding 50 could be reversed with the form/cladding 50 on the tall form side 60 and the foam boards 40 being stacked on the short form side 62. Or, in FIG. 14 the bricks could be stacked on the tall form side 60. In addition, the bracing may be of any kind known in the art, either internal and/or external or any combination thereof. Finally, in all FIGS. 6 through 14, at least part or both sides of the forms could be set during the casting process.

In another embodiment of the invention, removable form boards may be used multiple times in one day. Since the no-slump concrete has a tendency to set up much faster than a more liquid concrete, the lower form boards may be removed within as little as an hour or two after concrete placement and may be reused as the form boards for the upper section of the same wall on the same day.

From the description above, a number of advantages of some embodiments of my thixotropic concrete forming system become evident:

(a) The present invention provides an inexpensive way to significantly reduce the hydrostatic pressure created when freshly mixed concrete is cast into a vertical form.

(b) The present invention permits much weaker, simpler and less expensive forming systems that have to withstand the greatly reduced amount of hydrostatic pressure in the forms.

(c) The present invention enables the use of wall cladding materials as stay-in-place concrete forms and eliminates the redundant steps of using removable forms.

(d) The present invention permits substantially less bracing to support the various types of stay-in-place or removable forms.

(e) The present invention eliminates the need for form ties in cast-in-place concrete construction which facilitates the inexpensive use of form liners and the ability to use slip form stone masonry techniques to build veneer concrete walls.

(f) The present invention greatly decreases the likelihood of concrete leakage which permits the forms to be simply butted together and prevents concrete leakage that could blemish the face of stay-in-place cladding materials used as forms or placed inside of forms.

(g) The present invention permits the removal of forms within one or two hours and thereby enables the forms to be used multiple times a day.

(h) The present invention permits the efficient utilization of a horizontally oriented forming system which is consistent with many finished wall claddings such as siding, brick and stone that are also horizontally oriented.

(I) The present invention provides a simple process by which the concrete cast into a vertical form can be visually observed at close proximity while it is being vibrated to ensure the concrete fills the form and is thoroughly consolidated and integrated.

Although the description above contains many specifications, these should not be construed as limiting the scope of the embodiments but as merely providing illustrations of some of several embodiments. Thus the scope of the embodiments should be determined by the appended claims and their legal equivalents, rather than by the examples given.

What I claim is:

1. A method of reducing the hydrostatic pressure created in a form when placing freshly mixed, highly thixotropic no slump concrete in the form, the method comprising:

a. erecting form boards to partially construct a vertical form having two or more spaced apart sides to form a cavity into which a monolithic concrete structure is to be cast in place in lifts and at least one said side erected in levels with a first level less than the height of said monolithic concrete structure and at least one subsequent level erected after one or more said lifts of concrete is cast into said cavity, b. casting one or more said lifts of no slump concrete into said cavity and each said lift is less than the height of said monolithic concrete structure and not higher than 48 inches and said no slump concrete is in a semi solid state that exerts little or no said hydrostatic pressure on said vertical form, c. vibrating a limited amount of said no slump concrete at any one time in a manner that limits the amounts of liquefied concrete and resultant hydrostatic pressure in said vertical form which causes said no slump concrete to be liquefied, visually consolidated, integrated into adjacent concrete and fill the immediate area of said cavity, d. ending said vibration to allow said no slump concrete to revert to its said semi solid state, e. repeating one or more above steps a through d until said vertical form is fully erected and a full height of said monolithic concrete structure is cast in place, whereby the amount of hydrostatic pressure present in said vertical form is reduced by said no slump concrete being contained in said semi solid state in said form and by limiting the amount of said no slump concrete being liquefied at any one time.

2. The method of reducing the hydrostatic pressure of claim 1 wherein said form boards have an inside and one or more types of cladding materials is placed against at least part of said inside and said cladding becoming permanently attached to said no slump concrete.

3. The method of reducing the hydrostatic pressure of claim 1 including positioning concrete reinforcement materials and box-outs inside said vertical form.

4. The method of reducing the hydrostatic pressure of claim 1 including casting higher slump concrete into an area of said vertical form where hydrostatic pressure is predetermined not to be an issue and integrating said higher slump concrete.

5. The method of reducing the hydrostatic pressure of claim 1 wherein one or more of said form boards are stay in place forms that permanently attach to said concrete.

6. The method of reducing the hydrostatic pressure of claim 1 wherein said vertical form is predominately exterior braced.

7. The method of reducing the hydrostatic pressure of claim 1 wherein said vertical form is predominately interior braced.

8. A method of reducing the hydrostatic pressure in a form created by placing freshly mixed, highly thixotropic no slump concrete comprising:

a. erecting a first side of a vertical form with form boards set to a predetermined height of a monolithic concrete structure to be cast in place, b. erecting at least a second side of said vertical form with said form boards spaced apart from said first side to form a cavity and said second side is erected in two or more levels with said no slump concrete cast into said cavity after erecting each said level and each said level having a height less than the height of said monolithic concrete structure, c. casting one or more lifts of said no slump concrete into said cavity and said no slump concrete is in a semi-solid state exerting little or no hydrostatic pressure on said vertical form and each said lift is less than the height of said monolithic concrete structure and not higher than 48 inches, d. vibrating said no slump concrete in a manner that limits the amount of said no slump concrete being liquefied at any one time to limit the amount of hydrostatic pressure in said vertical form and when said vibrating ends in each vibration area said no slump concrete reverts to its semi solid state and is visually consolidated and integrated into adjacent concrete to fill the immediate area of said vertical form, e. repeating one or more above steps a through d until said vertical form is fully erected to at least the full height of said monolithic concrete structure and said no slump concrete has been cast, vibrated, consolidated and integrated to the full height of said monolithic concrete structure, whereby said hydrostatic pressure is reduced in said vertical form by using said no slump concrete that exerts little or no said hydrostatic pressure when at rest and by limiting the amount of said no slump concrete being liquefied at any one time.

9. The method of reducing the hydrostatic pressure of claim 8 wherein said vertical form are predominately exterior braced.

10. The method of reducing the hydrostatic pressure of claim 8 including casting higher slump concrete into an area of said vertical form where hydrostatic pressure is predetermined not to be an issue and integrating said higher slump concrete.

11. The method of reducing the hydrostatic pressure of claim 8 wherein at least one or more of said vertical form are stay in place forms that permanently attach to said concrete.

12. The method of reducing the hydrostatic pressure of claim 8 wherein said form boards have an inside and cladding materials are placed against at least part of said inside and permanently attaches to said concrete.

13. The method of reducing the hydrostatic pressure of claim 8 wherein said vertical form is predominately interior braced.

* * * * *